US010961820B2

(12) United States Patent
Reed

(10) Patent No.: US 10,961,820 B2
(45) Date of Patent: Mar. 30, 2021

(54) SAND FALL-BACK PREVENTION TOOL

(71) Applicant: Halliburton Energy Services, Inc., Houston, TX (US)

(72) Inventor: Stewart Darold Reed, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/325,363

(22) PCT Filed: Jan. 3, 2017

(86) PCT No.: PCT/US2017/012025
§ 371 (c)(1),
(2) Date: Feb. 13, 2019

(87) PCT Pub. No.: WO2018/052470
PCT Pub. Date: Mar. 22, 2018

(65) Prior Publication Data

US 2019/0271210 A1 Sep. 5, 2019

Related U.S. Application Data

(63) Continuation-in-part of application No. PCT/US2016/051461, filed on Sep. 13, 2016.

(51) Int. Cl.

| | |
|---|---|
| ***E21B 34/08*** | (2006.01) |
| ***E21B 43/12*** | (2006.01) |
| ***E21B 21/10*** | (2006.01) |
| ***E21B 34/06*** | (2006.01) |

(52) U.S. Cl.
CPC ..... *E21B 34/08* (2013.01); *E21B 21/103* (2013.01); *E21B 34/066* (2013.01); *E21B 43/128* (2013.01)

(58) Field of Classification Search
CPC ..... E21B 34/08; E21B 34/066; E21B 21/103; E21B 43/128
USPC ..... 166/316
See application file for complete search history.

(56) References Cited

U.S. PATENT DOCUMENTS

| | | | | |
|---|---|---|---|---|
| 3,967,679 | A | 7/1976 | Liljestrand | |
| 4,817,739 | A | 4/1989 | Jeter | |
| 6,167,969 | B1 | 1/2001 | Schoeffler | |
| 6,289,990 | B1 * | 9/2001 | Dillon | E21B 34/08 166/319 |
| 6,543,532 | B2 | 4/2003 | Estep et al. | |

(Continued)

FOREIGN PATENT DOCUMENTS

| | | | |
|---|---|---|---|
| WO | 2018052396 | A1 | 3/2018 |
| WO | 2018052470 | A1 | 3/2018 |
| WO | 2018052857 | A1 | 3/2018 |

OTHER PUBLICATIONS

"SandRight Solids Fallback Preventer: Sand Management Tool"; Summit ESP, A Halliburton Service; 2019; 2 pages.

(Continued)

*Primary Examiner* — Matthew R Buck
*Assistant Examiner* — Patrick F Lambe
(74) *Attorney, Agent, or Firm* — Locke Lord LLP

(57) ABSTRACT

A sand bridge inducer for a downhole tool can include a wall defining a main opening therethrough and one or more angled passageways defined through the wall such that the one or more angled passageways open from a radially inward opening and traverse axially downward through the wall toward a radially outward opening.

20 Claims, 12 Drawing Sheets

(56) References Cited

U.S. PATENT DOCUMENTS

| | | | |
|---|---|---|---|
| 7,487,831 | B2 | 2/2009 | Pluchek et al. |
| 10,082,014 | B2 * | 9/2018 | Fielder, III ..... E21B 43/38 |
| 2005/0230120 | A1 | 10/2005 | Victor |
| 2013/0264069 | A1 | 10/2013 | Williamson, Jr. |
| 2013/0299181 | A1 | 11/2013 | Coyle et al. |
| 2013/0299200 | A1 | 11/2013 | Hughes et al. |
| 2014/0014358 | A1 | 1/2014 | Leitch |
| 2015/0300136 | A1 | 10/2015 | Jefferies et al. |

OTHER PUBLICATIONS

International Search Report, issued in PCT/US2017/051031, dated Dec. 22, 2017.
International Search Report issued in PCT/US2017/012025, dated Jun. 2, 2017.
International Search Report issued in PCT/US2016/051461 dated May 10, 2017.

* cited by examiner

SAND FALL-BACK PREVENTION TOOL

CROSS REFERENCE TO RELATED APPLICATIONS

This application is the national phase under 35 U.S.C. § 371 of International Application No. PCT/US2017/012025, filed Jan. 3, 2017, which is a Continuation-in-Part of International Application No. PCT/2016/051461, filed Sep. 13, 2016. The entire content of each is incorporated by reference herein.

BACKGROUND OF THE INVENTION

1. Field of the Invention

The present disclosure relates to downhole tools, and more particularly to tools for reduction of inoperability and/or damage of electrical submersible pumps due to solid particle (e.g., formation sand, proppant, and the like) fall back such as used in oil and gas wells.

2. Description of Related Art

Natural formation sands and/or hydraulic fracturing proppant (referred to herein as sand) in subterranean oil and gas wells can cause significant problems for electrical submersible pumps (ESPs). Once sand is produced through the ESP it must pass through the tubing string prior to reaching the surface. Sand particles often hover or resist further downstream movement in the fluid stream above the ESP or move at a much slower velocity than the well fluid due to physical and hydrodynamic effects. When the ESP is unpowered, fluid and anything else in the tubing string above the pump begins to flow back through the pump. Check valves are often used to prevent flow back while also maintaining a static fluid column in the production tubing. However check valves are subject to failures caused by solids including sand.

Such conventional methods and systems have generally been considered satisfactory for their intended purpose. However, there is still a need in the art for improved sand fall-back prevention/mitigation tools that protect the operability and reliability of ESPs. The present disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
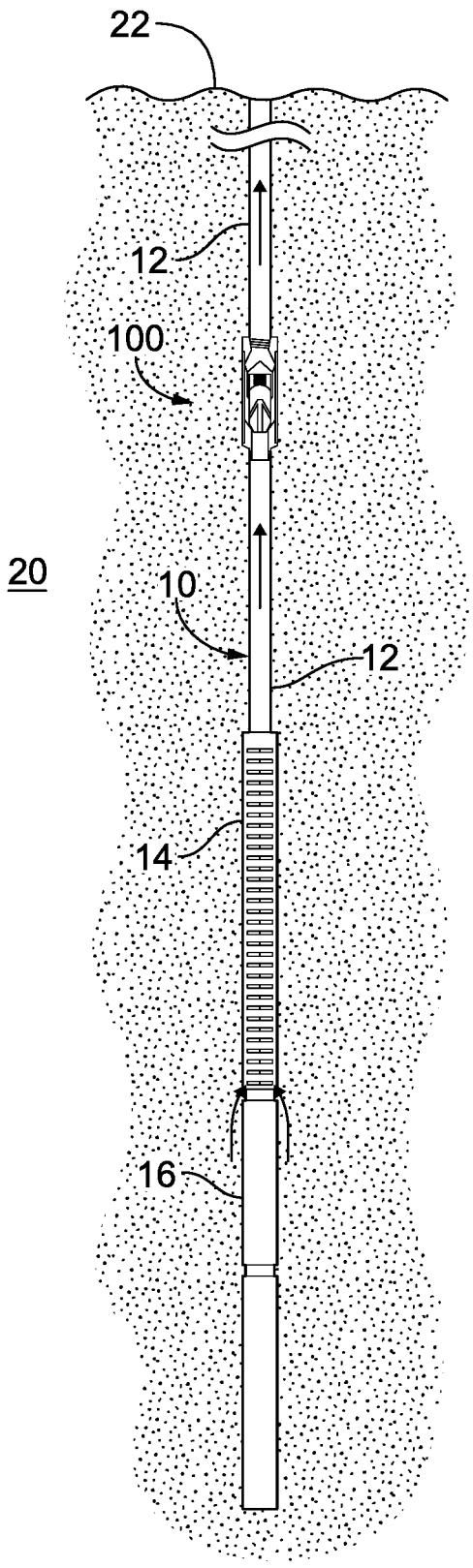
FIG. 1 is a schematic side elevation view of an exemplary embodiment of a downhole tool constructed in accordance with the present disclosure, showing the downhole tool in a string that includes a motor and electrical submersible pump (ESP), wherein the string is in a formation for production of well fluids that may contain any combination of water, hydrocarbons, and minerals that naturally occur in oil and gas producing wells.

Reference will now be made to the drawings wherein like reference numerals identify similar structural features or aspects of the subject disclosure. For purposes of explanation and illustration, and not limitation, a partial view of an exemplary embodiment of a downhole tool in accordance with the disclosure is shown in FIG. 1 and is designated generally by reference character 100. Other embodiments of downhole tools in accordance with the disclosure, or aspects thereof, are provided in FIGS. 2-15, as will be described. The systems and methods described herein can be used to mitigate, reduce or prevent fall-back sand reaching an electrical submersible pumps (ESP) in downhole operations such as in oil, gas, and/or water producing wells.

Figure 2:
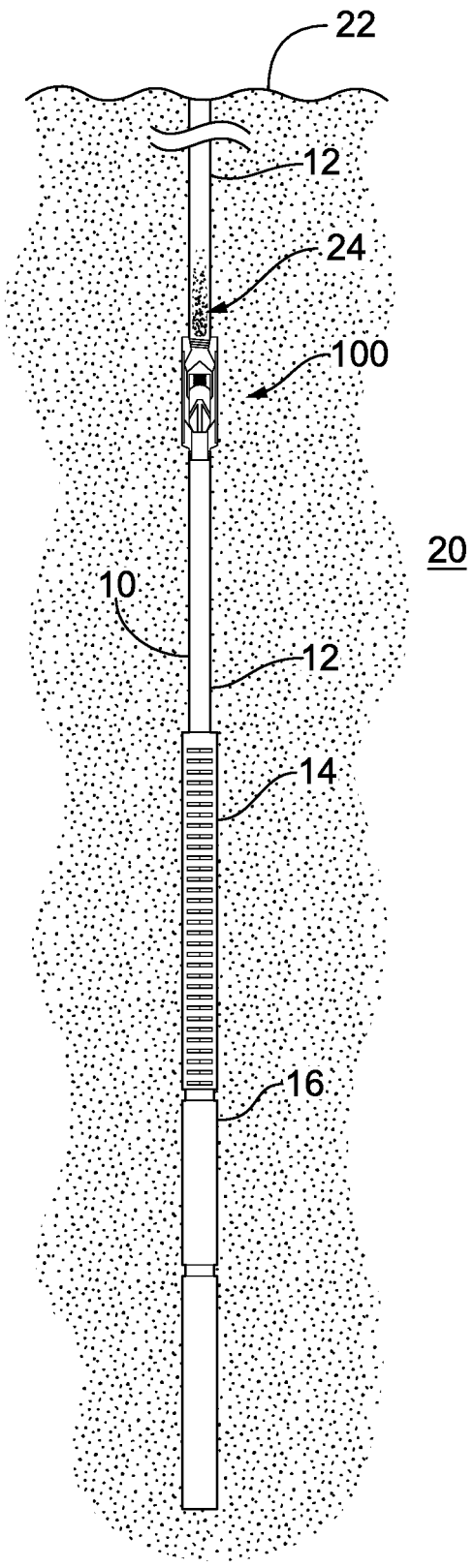
FIG. 2 is a schematic side elevation view of the downhole tool of FIG. 1, showing the tool preventing/mitigating fall-back sand from reaching the ESP during shutdown of the ESP.

String 10 includes production tubing 12, downhole tool 100, ESP 14, protector 16, and motor for driving ESP 14. These components are strung together in a formation for production, e.g., of oil, gas and/or water, from within formation 20. In FIG. 1, the flow arrows indicate operation of ESP 14 to receive fluids in from formation 20 then drive through production tubing 12 and downhole tool 100 to the surface 22. As shown in FIG. 2, when ESP 14 stops pumping, fall-back sand 24 in the production tubing 12 above downhole tool 100 recedes toward the ESP 14, but is mitigated or prevented from reaching ESP 14 by downhole tool 100.

Figure 3:
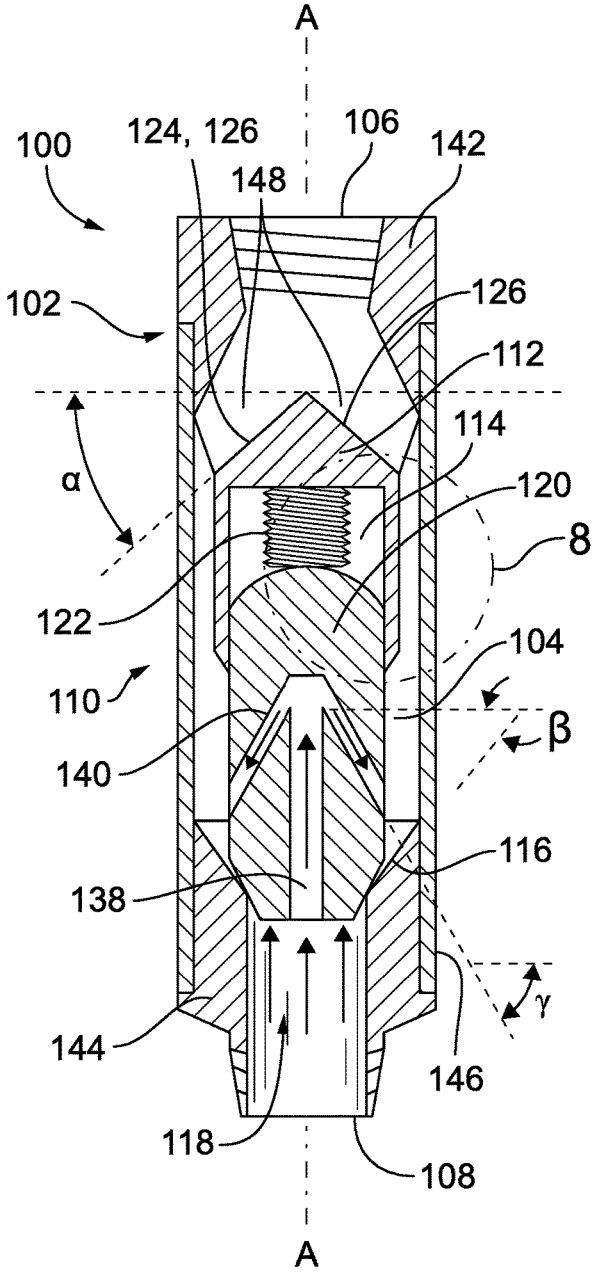
FIG. 3 is a schematic cross-sectional elevation view of the downhole tool of FIG. 1, showing the valve poppet in the closed position with flow arrows indicating the flow during opening of the poppet valve and just prior to establishment of a full flow condition.

With reference now to FIG. 3, downhole tool 100 is configured for sand fall-back prevention/prevention as described above. Downhole tool 100 includes a housing 102 defining a flow path 104 therethrough in an axial direction, e.g. generally along axis A, from an upper opening 106 to a lower opening 108. Depending on the direction of flow, upper opening 106 may be an inlet or an outlet, and the same can be said for lower opening 108. Those skilled in the art will readily appreciate that while axis A is oriented vertically, and while upper and lower openings 106 and 108 are designated as upper and lower as oriented in FIGS. 3-7 and FIGS. 13-15, other orientations are possible including horizontal or oblique angles for axis A, and that the upper opening 106 need not necessarily be above lower opening 108 with respect to the direction of gravity. Upper opening 106 is closer than lower opening 108 in terms of flow reaching surface 22, shown in FIG. 1, regardless of the orientation of downhole tool 100.

A poppet valve 110 is mounted within the housing. The poppet valve 110 includes an upper member 112 defining an upper chamber 114 mounted in the flow path 104 so that flow through the flow path 104 flows around the upper member 112. A valve seat 116 is mounted in the flow path 104 with an opening 118 therethrough. A valve poppet 120 is mounted for longitudinal movement, e.g., in the direction of axis A, within the flow path 104 between a closed position, shown in FIG. 3, in which the valve poppet 120 seats against the valve seat 116 to block flow through the flow path 104, and an open position, shown in FIG. 4, in which the valve poppet 120 is spaced apart from the valve seat 116 to permit flow through the flow path 104.

Figure 4:
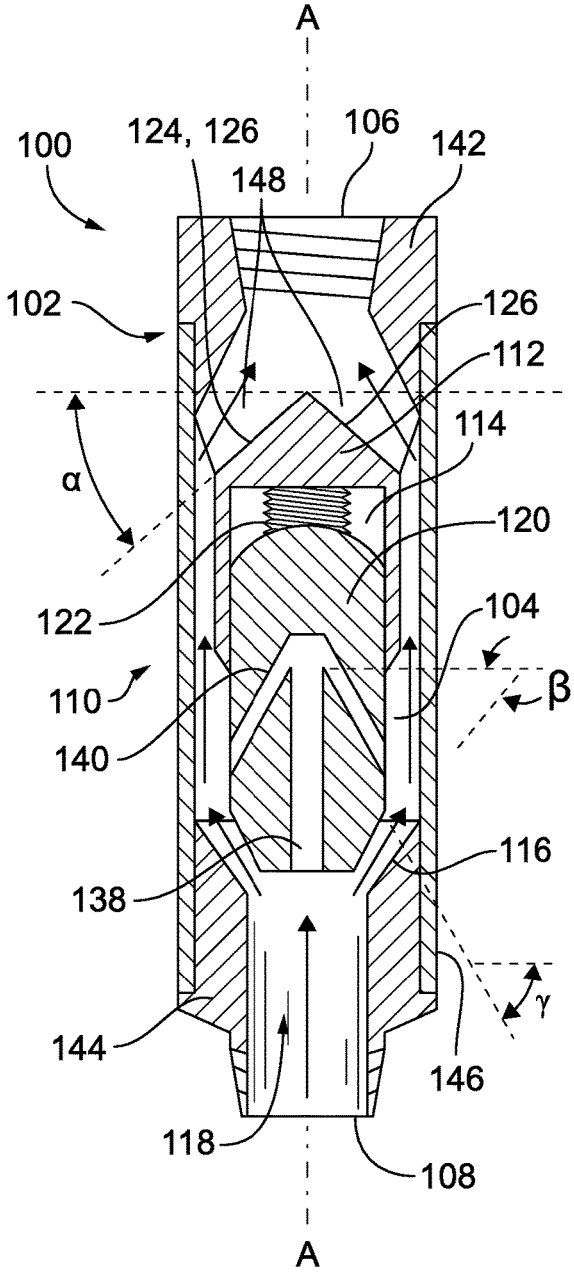
FIG. 4 is a schematic cross-sectional elevation view of the downhole tool of FIG. 1, showing the valve poppet in the open position, flowing as during production with a full flow condition.

In both the open and closed positions, as shown in FIGS. 4 and 3, respectively, the valve poppet 120 remains at least partially within the upper chamber 114 so that the upper chamber 114 is always enclosed to prevent/mitigate accumulation of fall-back sand above the valve poppet 120. A biasing member 122 is seated in the upper chamber 114 biasing the valve poppet 120 toward the valve seat 116. The biasing member can be configured to provide either an opening or closing force sized/calibrated with respect to fluid properties, slurry characteristics and flow conditions for moving the valve poppet 120 from the open/closed position to the closed/opened position. Biasing member 122 may be used to eliminate the need for gravitational forces assisting valve closure, e.g., in horizontal or deviated wells.

The upper member 112 includes an upper surface 124 with at least one angled portion 126 that is angled, e.g. at angle $\alpha$ below the level dashed line in FIG. 3, to resist accumulation of sand on the upper surface. For example angle $\alpha$ can be greater than the angle of repose, e.g. 45° of the fall-back sand and/or debris expected to be present in downhole tool 100.

Figure 8:
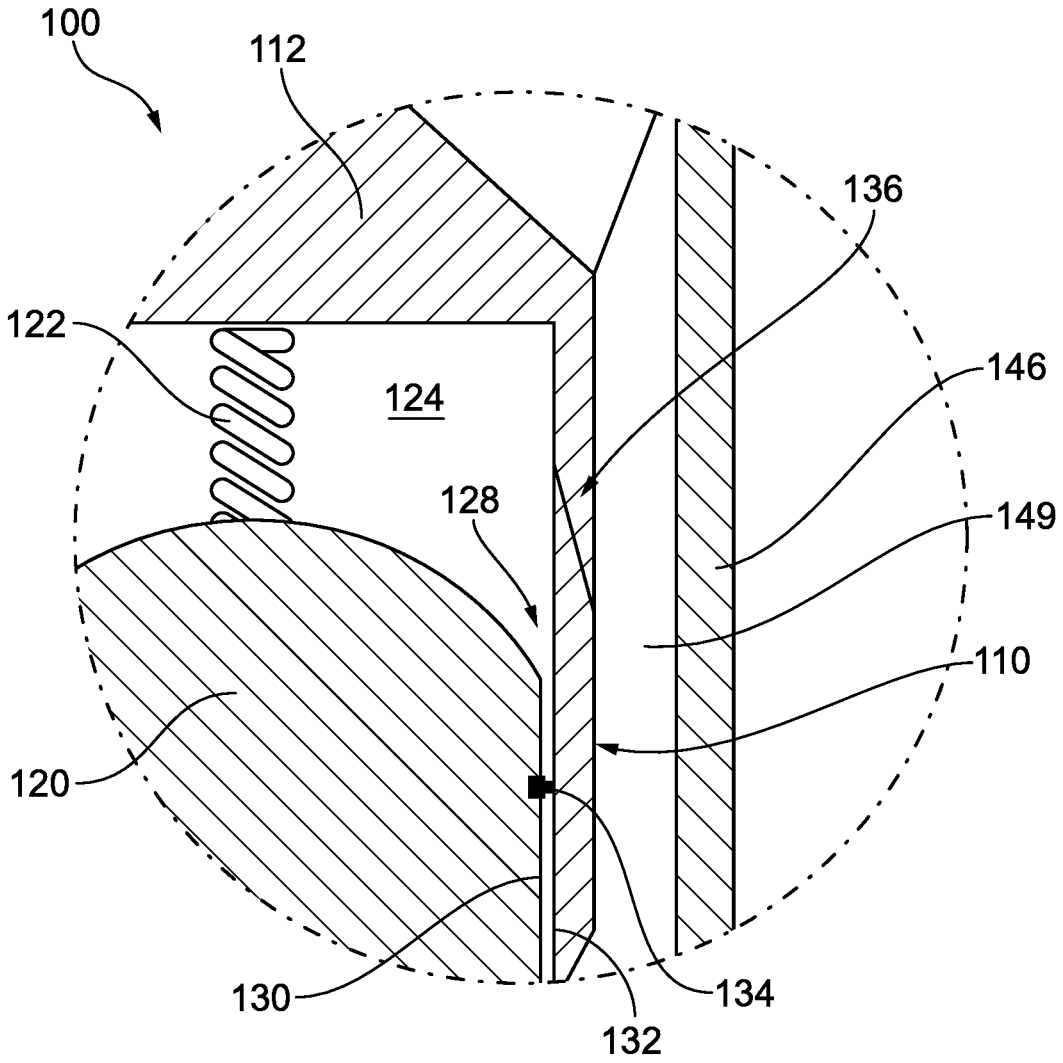
FIG. 8 is a schematic cross-sectional elevation view of a portion of the downhole tool of FIG. 1, showing the weep hole and wiper seal features of the valve that assist in enabling and protecting the upper movement of the valve's poppet.
Figure 9:
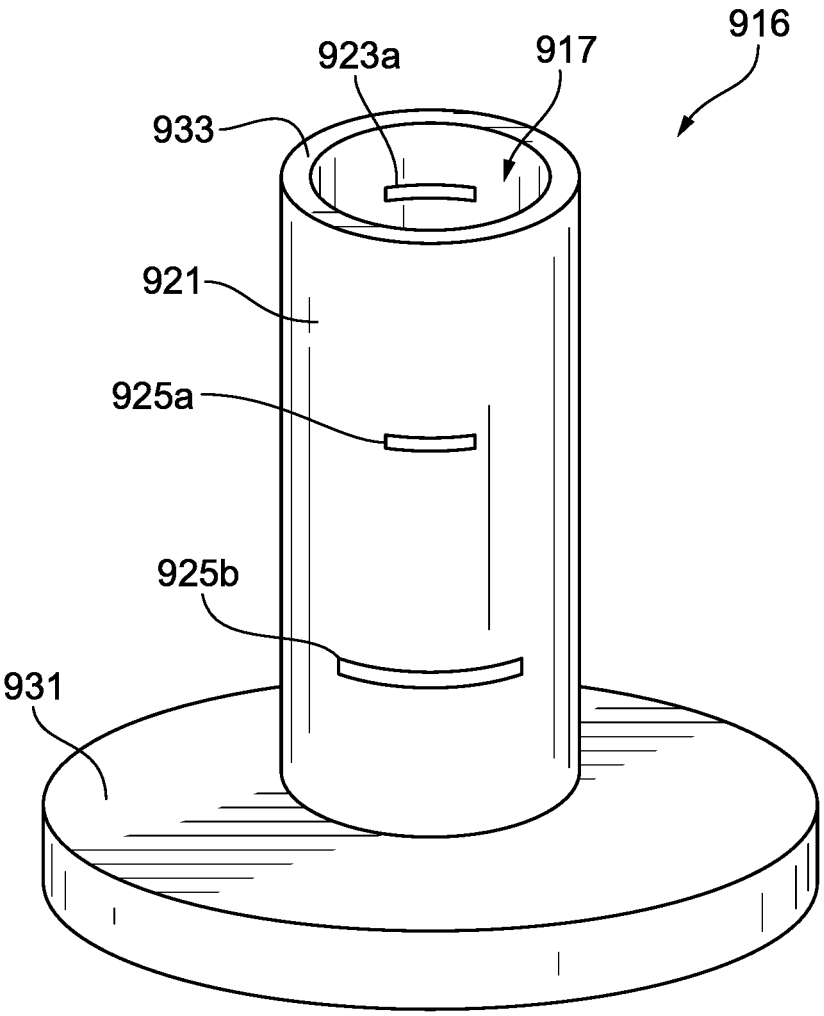
FIG. 9 is a perspective view of an embodiment of a sand bridge inducer in accordance with this disclosure, showing embodiments of radially outward openings of upwardly angled passageways defined through a wall of the inducer.
Figure 10:
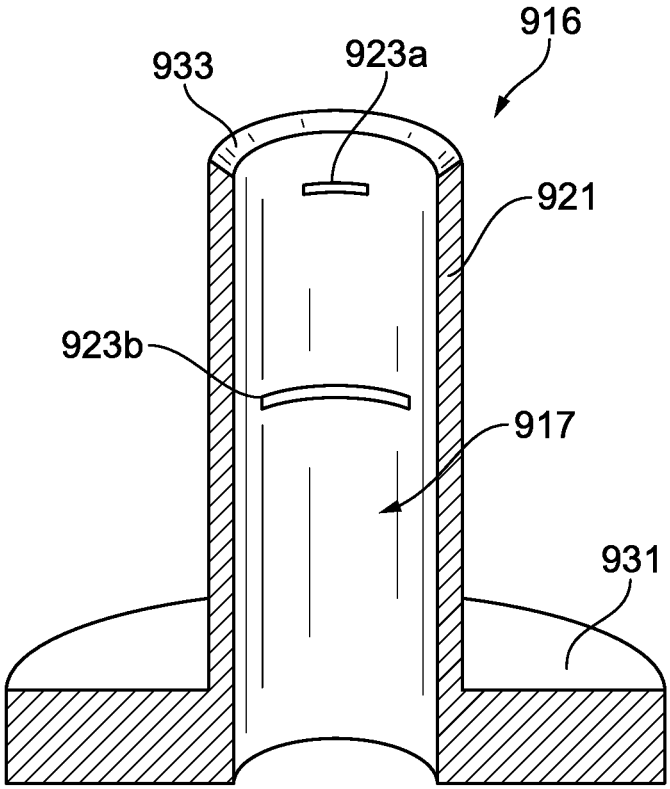
FIG. 10 is a perspective cross-sectional view of the embodiment of FIG. 9, showing embodiments of radially inward openings of upwardly angled passageways defined through a wall of the inducer.

As shown in FIG. 8, the valve poppet 120 is narrower than the upper chamber 124, and there is therefore a gap 128 to allow movement of the valve poppet 120 without resistance from fall-back sand or debris. Valve poppet 120 includes an axially oriented perimeter surface 130 matched in shape, e.g., cylindrical, with an axially oriented interior surface 132 of the upper chamber 124. A wiper seal 134 engages between the valve poppet 120 and the upper member. The wiper seal 134 may be configured to allow passage of fluid while inhibiting passage of sand or debris, to keep upper chamber 124 and gap 128 clear of sand or debris. While only one wiper seal 134 is shown, those skilled in the art will readily appreciate that any suitable number of wiper seals can be used, or other sealing mechanisms may be employed to achieve the same result of restricting debris passage while allowing liquid to seep across the sealing interface. A weep hole 136 can be defined through the upper member 112 from a space outside the upper chamber 124 to a space inside the upper chamber 124. The weep hole 136 is configured to equalize pressure between the flow space outside the upper chamber 124 with the cavity inside the upper chamber 124. A filter material can be included within the weep hole 136 to assist with preventing sand/debris from entering the upper chamber 124. Upper chamber 124 can be lengthened to any suitable length along valve poppet 120 for a given application, as the length helps prevent debris migration into upper chamber 124.

With reference again to FIG. 4, the valve seat 116 is defined by an angular surface, angled at angle $\beta$ below horizontal as oriented in FIG. 4. This encourages wedging of sand during closing of the valve poppet 120 against the valve seat 116. The angle $\beta$ also serves to limit restrictive forces while opening the poppet valve 110. A poppet channel 138 is defined through the valve poppet 120 for limited fluid communication through the flow path 104 with the valve poppet 120 in the closed position. The poppet channel 138 can have a flow area equal to one-half of that through the flow path 104 with poppet valve 120 in the open position, or greater. The poppet channel 138 can include one or more tributaries 140, each with an opening on the peripheral surface 130 of the poppet valve 120. Each of the tributaries 140 of the poppet channel 138 is directed downward toward the valve seat 116 for initiating a buoyancy change in sand seated between the valve seat 116 and the valve poppet 120 prior to the valve poppet 120 moving from the closed position to the open position. This type of flow is indicated in FIG. 3 with flow arrows. Each tributary 140 of the poppet channel can be defined along a tributary axis angled downward equal to an angle $\gamma$, e.g., or more than 45° from level. This angle $\gamma$ mitigates sand migrating upward through the channel tributary 140. Housing 102 includes a head 142 including the upper member 112 and upper opening 106. When excessive sand is present, the angle $\gamma$ and small channel diameter can prevent a constant flow of sand slurry in the reverse direction thereby creating a plug effect.

Housing 102 also includes a base 144 including the lower opening 108 and the valve seat 116. Housing 102 further includes a housing body 146 mounted to the head 142 and base 144, spacing the head 142 and base 144 apart axially. Flow path 104 includes upper opening 106, passages 148 through head 142, the space 149 between housing body 146 and poppet valve 110 (as shown in FIG. 8), the space between valve poppet 120 and valve seat 106, opening 118 through valve seat 116, and lower opening 108. Head 142 and base 144 can include standard external upset end (EUE) connections for ease of installation of downhole tool 100 in a production tubing string above an ESP. Multiple downhole tools 100 can be strung together for cumulative effect and redundancy. Surfaces of head 142 may be coated or hardened to help mitigate erosion. The flow area can be slightly larger than the passageway of an ESP pump head with shaft coupling installed. Tool 100 may have multiple sizes to reflect a like ESP pump head passage way with shaft coupling installed.

Figure 5:
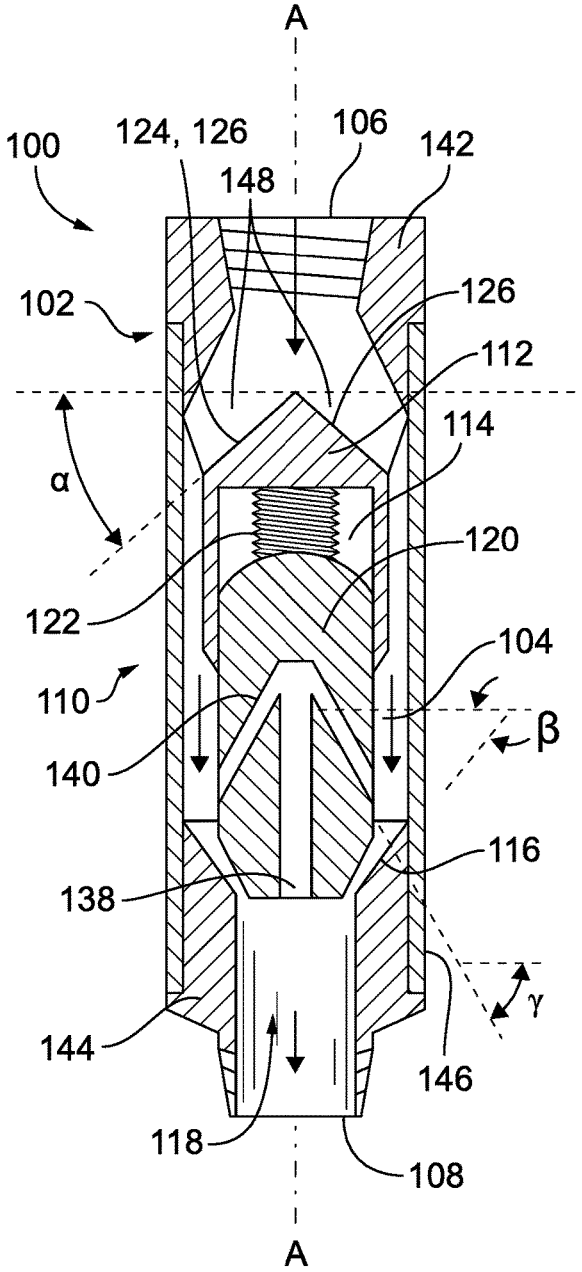
FIG. 5 is a schematic cross-sectional elevation view of the downhole tool of FIG. 1, showing the valve poppet closing immediately after powering down the ESP thereby inducing a reverse flow condition in the production tubing and valve.
Figure 6:
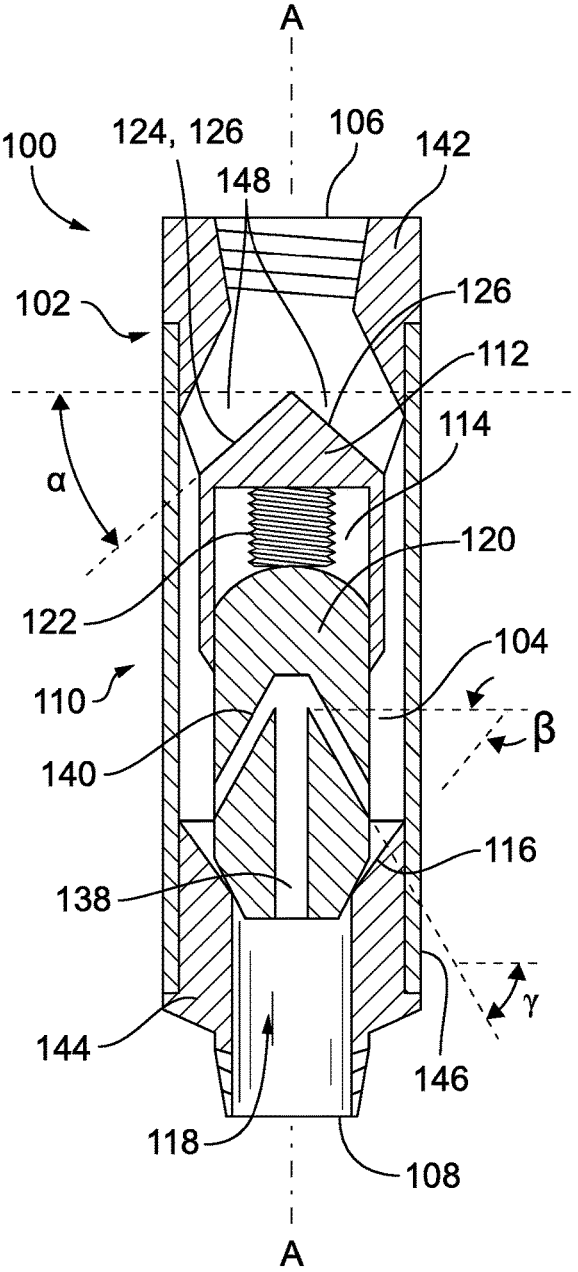
FIG. 6 is a schematic cross-sectional elevation view of the downhole tool of FIG. 1, showing the valve poppet in the closed position restricting/mitigating sand fall-back toward the ESP.

A method of reducing fall-back sand reaching an electrical submersible pump (ESP) includes holding a valve poppet, e.g., valve poppet 120, in an open position by operating an ESP, e.g., ESP 14, to drive flow through a flow path, e.g. flow path 114, past the valve poppet, as shown in FIG. 4, where the flow arrows indicate flow with the valve poppet in an open and flowing position. The method also includes moving the valve poppet into a closed position blocking the flow path by reducing flow from the ESP. FIG. 5 shows the valve poppet 120 moving to the closed position, wherein the flow arrows indicate back flow during shut down of ESP 14. In the closed position of poppet valve 120, shown in FIG. 6, valve poppet 120 restricts sand at the valve seat interface, thereby causing sand accumulation alongside the valve poppet 120, within the tributaries 140 and throughout the normal downstream flow path(s) of flow path 104, passages 148, and upper opening 106 while the valve poppet is in the closed position. In the closed position, back flow can be allowed thorough a poppet channel, e.g., poppet channel 138, defined through the valve poppet. This can allow for flow of chemical treatments for ESP from the surface during shutdown, for example.

Figure 7:
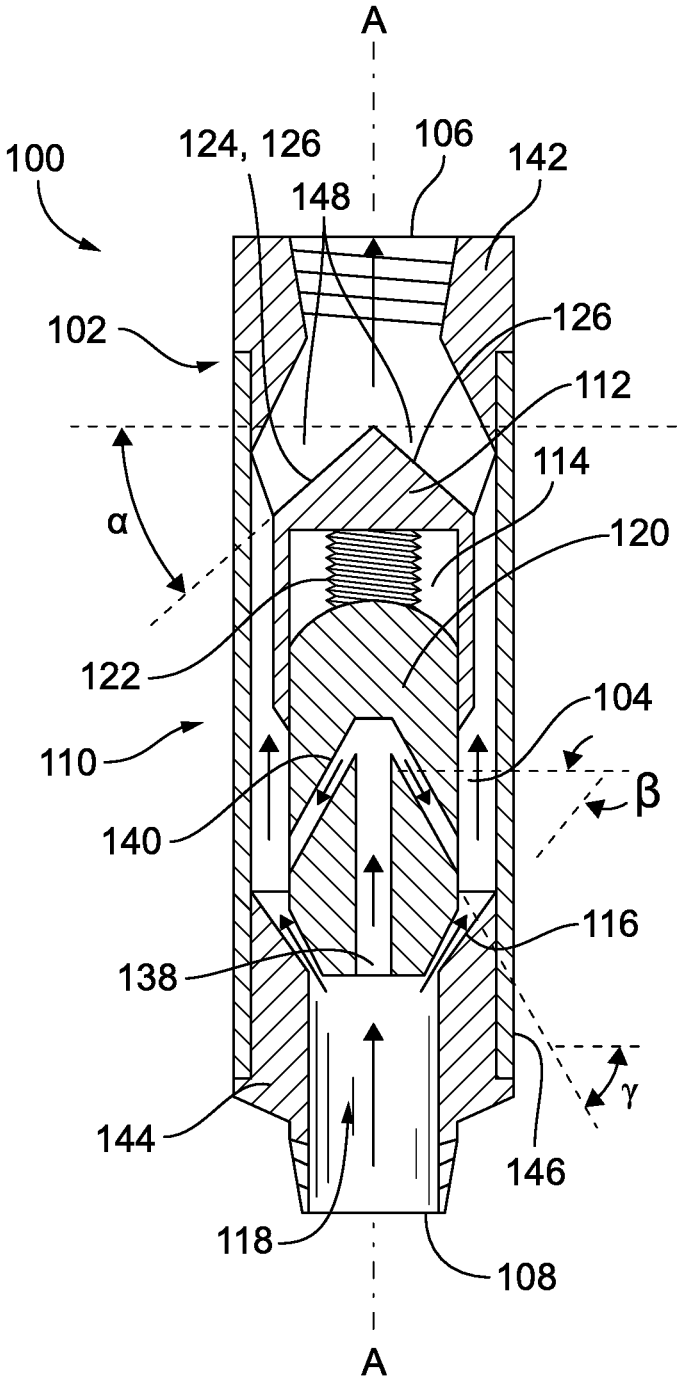
FIG. 7 is a schematic cross-sectional elevation view of the downhole tool of FIG. 1, showing the valve poppet re-opening while sand is restrained above the lower opening of the downhole tool.

Referring now to FIG. 3, initiating movement of the valve poppet from the closed position to an open position can be done by directing flow through a tributary, e.g. tributary 140, of the poppet channel defined through the valve poppet. This flow through the tributary is directed at sand accumulated between the valve poppet and an adjacent valve seat, e.g. valve seat 116. Thereafter, as ESP increases the flow pressure, the valve poppet overcomes the biasing member, e.g., biasing member 122, to move to the open position as shown in FIG. 7. This discharges accumulated fall-back sand from a tool, e.g., downhole tool 100, in an upward direction toward the surface 22 as indicated by the flow arrows in FIG. 7.

Accordingly, as set forth above, the embodiments disclosed herein may be implemented in a number of ways. For example, in general, in one aspect, the disclosed embodiments relate to a downhole tool for sand fall-back prevention. The downhole tool comprises, among other things, a housing defining a flow path therethrough in an axial direction from an upper opening to a lower opening. A poppet valve is mounted within the housing. The poppet valve includes an upper member defining an upper chamber mounted in the flow path so that flow through the flow path flows around the upper member, and a valve seat mounted in the flow path with an opening therethrough. A valve poppet is mounted for longitudinal movement within the flow path between a closed position in which the valve poppet seats against the valve seat to block flow through the flow path and an open position in which the valve poppet is spaced apart from the valve seat to permit flow through the flow path.

In general, in another aspect, the disclosed embodiments related to a method of reducing fall-back sand reaching an electrical submersible pump (ESP). The method comprises, among other things, holding a valve poppet in an open position by operating an ESP to drive flow through a flow path past the valve poppet, moving the valve poppet into a closed position blocking the flow path by reducing flow from the ESP, blocking sand through the flow path with the valve poppet, and preventing accumulation of sand above, e.g., directly above, the valve poppet while the valve poppet is in the closed position.

Referring additionally to FIGS. 9-12, various views of an embodiment of a sand bridge inducer 916 for a downhole tool are shown. The sand bridge inducer 916 includes one or more angled passageways 919*a*, 919*b* defined through a wall 921 of the sand bridge inducer valve seat 916. The one or more angled passageways 919*a*, 919*b* open from a radially inward opening 923*a*, 923*b* and traverse axially downward through the wall 921 of the sand bridge inducer valve seat 916 toward a radially outward opening 925*a*, 925*b*. For example, in certain embodiments, the radially inward opening 923*a*, 923*b* can be axially above the radially outward opening 925*a*, 925*b* as oriented in FIGS. 11A, 11B, and 12. Any other suitable relative arrangement is contemplated herein.

In certain embodiments, the one or more angled passageways 919*a*, 919*b* can include one or more linear passageways defined between a respective radially inward opening 923*a*, 923*b* and radially outward opening 925*a*, 925*b*. In certain embodiments, as shown, the passageways 919*a*, 919*b* can have a uniform cross-sectional flow area between the radially inward opening 923*a*, 923*b* and radially outward opening 925*a*, 925*b*. It is contemplated that non-uniform cross-sectional areas (e.g., reducing or expanding, tapered) can be utilized. The angled passageways 919*a*, 919*b* can be and/or include any other suitable flow path (e.g., non-linear, having concave or convex curved features as part of or making the entire length of the upward flow path, having end connected linear segments creating a progressing or digressing upward flow angle) within the wall 921 of the sand bridge inducer 916 between the radially inward opening 923*a*, 923*b* and the radially outward opening 925*a*, 925*b*.

Figure 11A:
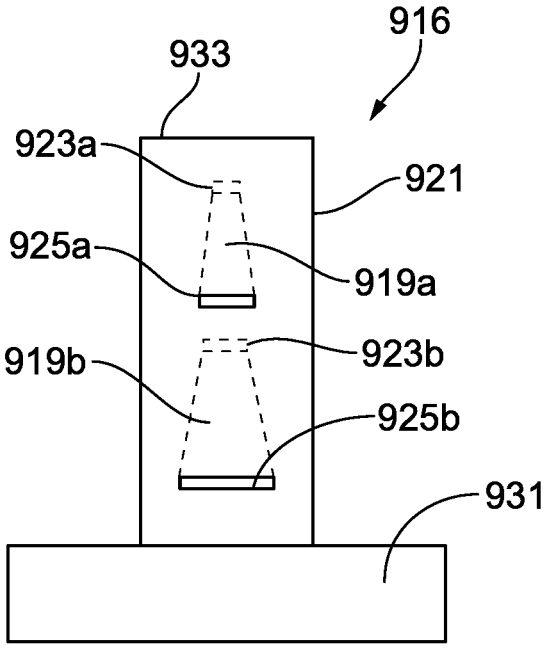
FIG. 11A is a side view of the embodiment of FIG. 9, schematically showing embodiments of upwardly angled passageways in phantom defined through a wall thereof.
Figure 11B:
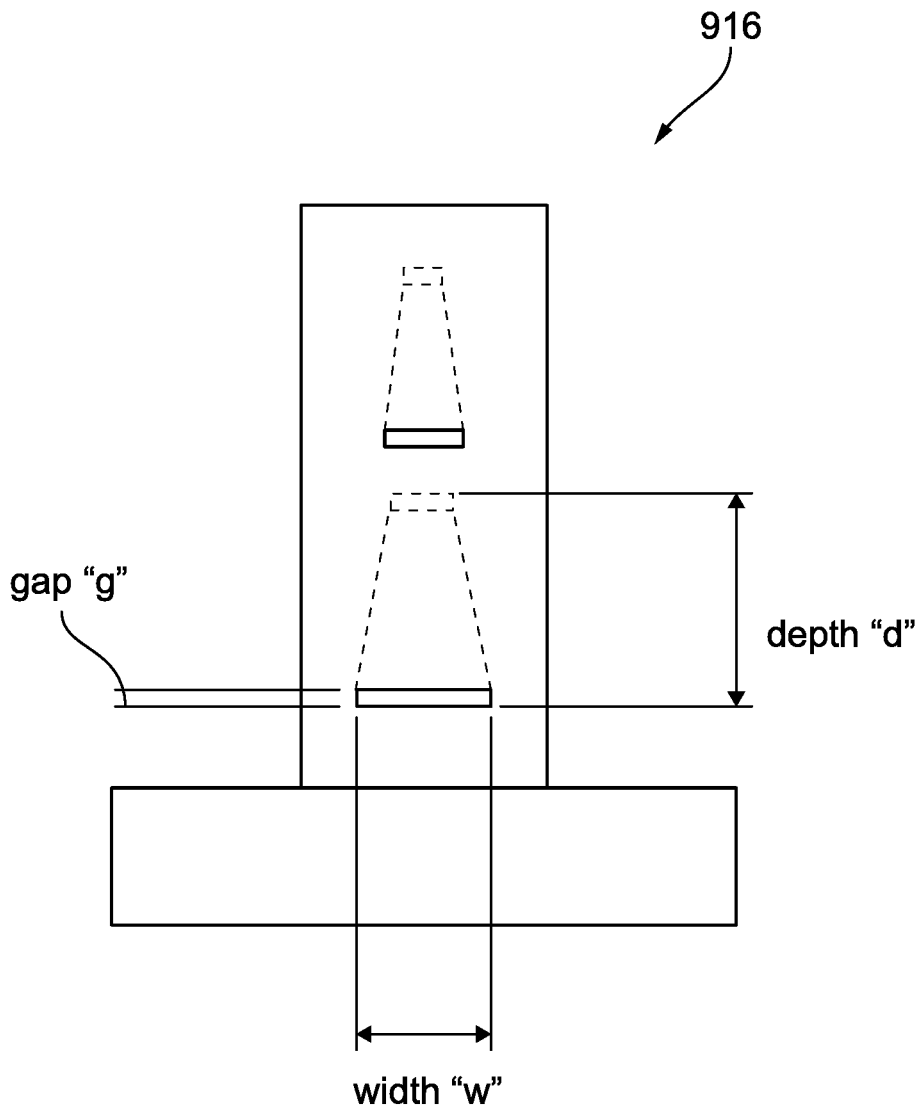
FIG. 11B is a side view of the embodiment of FIG. 9, schematically showing embodiments of upwardly angled passageways in phantom defined through a wall thereof, indicating dimensions as described herein.

In certain embodiments, the one or more angled passageways 919*a*, 919*b* can include one or more plate flow passageways including a rectangular cross-section (e.g., as shown in FIG. 11A). Any other suitable cross-sectional shape (e.g., elliptical, square, round) is contemplated herein. In certain embodiments, the cross-sectional area of the one or more plate flow passageways can include any suitable (e.g., 10:1) width "w" to gap "g" ratio (e.g., as shown in FIG. 11B), for example. Any other aspect ratio is contemplated herein.

Figure 12:
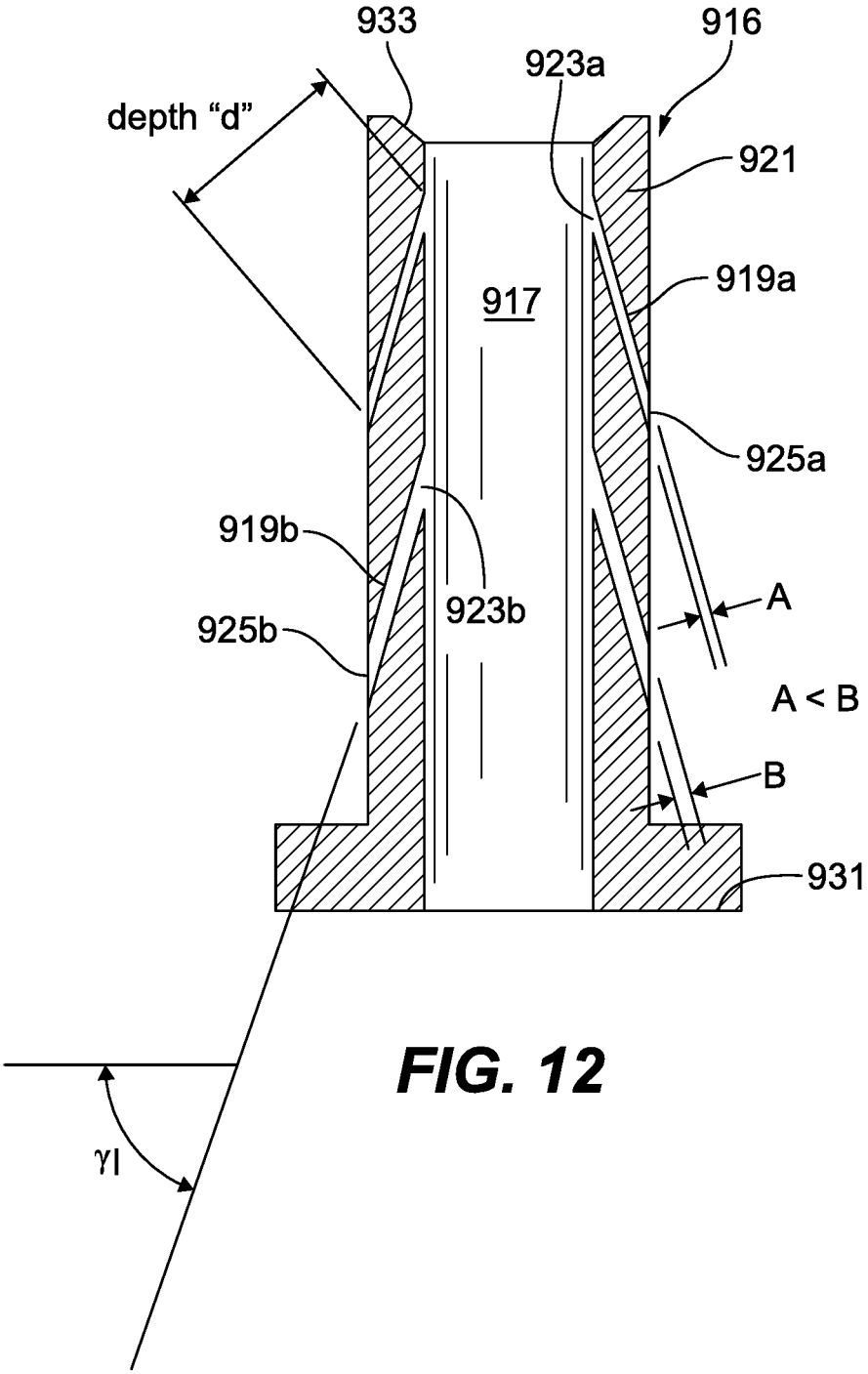
FIG. 12 is a cross-sectional view of the embodiment of FIG. 9.
Figure 13:
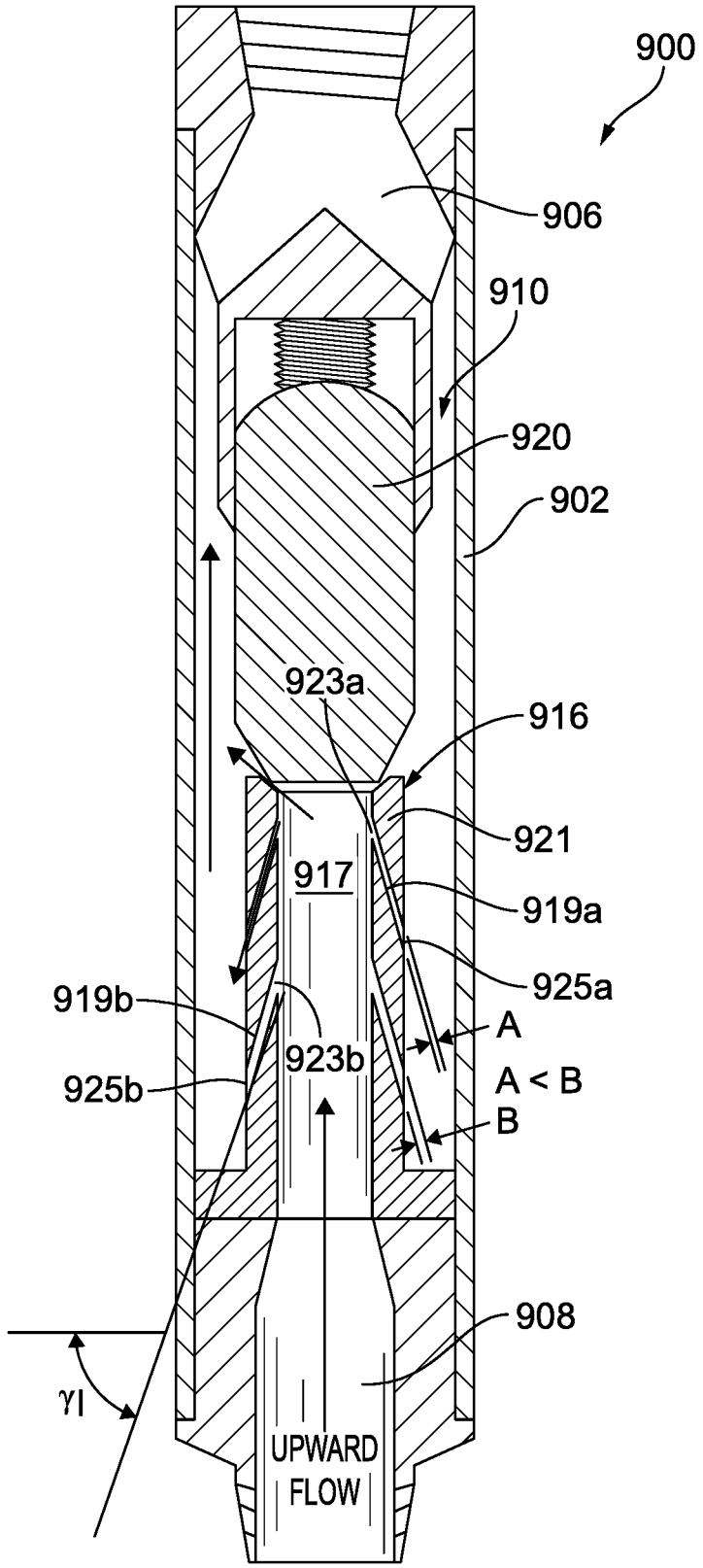
FIG. 13 is a cross-sectional view of an embodiment of a downhole tool in accordance with this disclosure, shown in an upflow condition.
Figure 14:
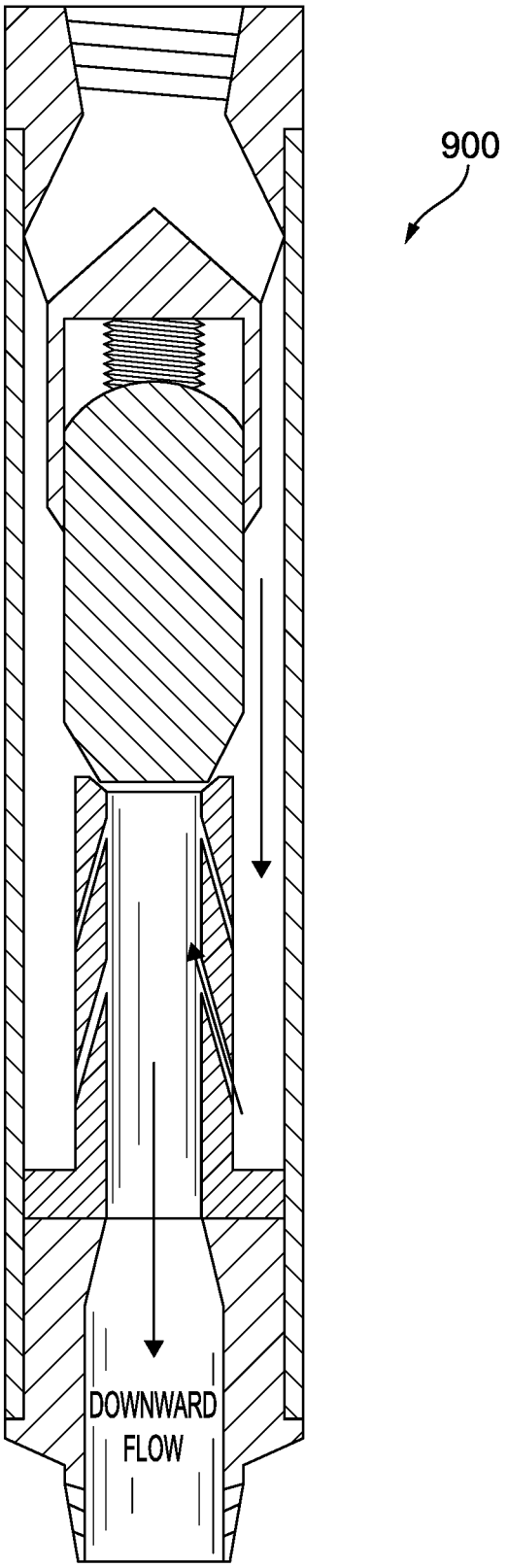
FIG. 14 is a cross-sectional view of the embodiment of FIG. 13, shown in a downflow condition.

In certain embodiments, as shown, the gap dimension "g" can be vertical or aligned to the axial direction/axial flow path (e.g., as shown in FIG. 11B). It is also contemplated that the gap dimension "g" can be the distance (e.g., the shortest distance) between the interior walls of the angled passageways, irrespective of axial relation (e.g., orthogonal to flow direction). As shown in FIGS. 12 and 13, the gap "g" is represented by two gap dimensions "A" and "B" indicating differing sizes in the embodiment shown. As described herein, the term gap dimension "g" is generic to any and all suitable gap dimensions as appreciated by those having ordinary skill in the art and shown in the various figures (e.g., "g" as shown in FIG. 11B, "A" and/or "B" as shown in FIGS. 12-14). The width dimension "w" can be horizontal or orthogonal to the axial direction/axial flow path.

The at least one of the angled passageways 919*a*, 919*b* can include an angle $\gamma_I$ of 45 degrees or higher between the radially inward opening 923*a*, 923*b* and radially outward opening 925*a*, 925*b*. Any other suitable angle is contemplated herein.

The angled passageways 919*a*, 919*b* can be cut at a severe angle $\gamma_I$ for at least two reasons. First, an aggressive angle, e.g., greater than the angle of repose for the material such as sand that is desired to be blocked from back flow, can hinder sand from flowing upward through the passageways 919*a*, 919*b*. Second, the angled orientation allows for a longer passageway 919*a* in the depth dimension "d" (e.g., as shown in FIGS. 11B and 12), 919*b*, given the wall thickness of inducer 906 into which the passageways are formed, thereby forming a "plate" like flow path geometry. For example, the depth "d" of the passageway relative to the gap dimension "g" (which can include dimensions "A" and/or "B" for example) may be a 20:1 ratio (e.g., 1 inch depth "d" for a 0.05 inch gap). Any other suitable ratio showing a substantial depth to gap geometry is contemplated herein.

At least one of the one or more angled passageways 919*a*, 919*b* can be sized to promote a sand bridging effect therein without allowing sand to travel into the main opening 917. The one or more angled passageways 919*a*, 919*b* can include at least two passageways of different flow area. For example, as shown in FIGS. 12-14, a first passageway 919*a* of the at least two passageways can have a smaller flow area and/or smaller gap dimension "A" than a second passageway 919*b* gap dimension "B". Also as shown, the first passageway 919*a* can be disposed axially upward of the second passageway 919*b*. In certain embodiments, the first passageway 919*a* can include a smaller gap dimension but the same flow area as the second passageway 919*b* (e.g., the first passageway 919*a* can be wider but narrower).

In certain embodiments, the first passageway 919*a* includes a gap "A" and a flow area that is smaller than the second passageway 919*b*. The smaller gap of the first passageway 919*a* can be sized to not require leak-off to induce a sand bridge in the first passageway 919*a* path, whereas the larger gap of the second passageways 919*b* can require higher sand concentrations to have an effective sand bridge.

In certain embodiments, the smaller first passageway 919*a* can be sized to allow leak-off during downflow, e.g., such that mostly or only liquid will be removed from the slurry flow by way of the first passageway 919*a*. Path 919*a* leaks off fluid upstream of 919*b* thereby causing a higher concentration of sand particles present at the opening of 919*b*. The higher concentration of sand particles promotes sand bridging in 919*b*, e.g., when 919*b* has been configured with a gap dimension larger than 919*a*. The larger second passageway 919*b* can be designed to allow sand bridging therein such that sand (and/or other sediment or solid particulate) can collect in the second passageway 919*b* without being able to flow into the main opening 917.

The sand bridge inducer 916 can include a top hat shape or any other suitable shape. For example, as shown, the sand bridge inducer 916 can include a mounting flange 931, e.g., for mounting in a tool housing such that flow must flow through the main opening (e.g., via the angled passageways 919*a*, 919*b*). In certain embodiments, the sand bridge inducer 916 can include an interface 933 at a top (axially upward) portion thereof, e.g., for acting as a valve seat for sealing interaction between a poppet and the sand bridge inducer 916. In certain embodiments, it is contemplated that the top portion of the sand bridge inducer 916 can be sealed in any suitable manner.

If the main opening 917 is sealed at the top (e.g., from a cap, from design, from a poppet blocking the main opening 917), flow will have to pass through the angled passageways 919*a*, 919*b* to flow into the main opening 917. In this regard, the upward angled passageways 919*a*, 919*b* are sized, shaped, angled, and/or otherwise designed to allow liquid to travel through the one or more angled passageways 919*a*, 919*b* without allowing sand and/or other sediment/solid particulate from entering the main opening 917. In upward flow, sand is allowed to go through the passageways 919*a*, 919*b*, e.g. when upward flow sand concentrations are less than 0.1% by volume, or through 917 if the poppet 920 opens. The poppet will open when plugging occurs, e.g. when sand slugs having a high concentration of sand in the tubing flow occurs during upward flow, or high flow rates are encountered.

Embodiments, of sand bridge inducer 916 can be utilized in a valve assembly, e.g., as a valve seat for example. Referring to FIG. 13, certain embodiments of a downhole tool 900 for sand fall-back prevention can include a housing 902 defining a flow path therethrough in an axial direction from an upper opening 906 to a lower opening 908. The tool 900 includes a poppet valve 910 mounted within the housing 902. The tool 900 and/or poppet valve 910 can be similar as described above and/or any other suitable poppet valve assembly.

As shown in FIG. 13, in certain embodiments, the poppet valve 910 can include a sand bridge inducer 916 as described above used as a valve seat mounted in the flow path with a main opening 917 therethrough. A valve poppet 920 is mounted for longitudinal movement within the flow path between a closed position (e.g., as shown in FIGS. 13-15) in which the valve poppet 920 seats against the sand bridge inducer 916 to block flow through the upper valve seat space of main opening 917 and an open position (e.g., as shown in phantom in FIG. 13) in which the valve poppet is spaced apart from the valve seat to permit flow through the upper valve seat space of main opening 917.

In certain embodiments, as shown, the poppet valve 910 includes a poppet 920 that may be solid and/or does not include any flow passage therethrough, for example. Any other suitable poppet (e.g. having other shapes being solid and/or having flow passages) or assembly is contemplated herein.

Figure 15:
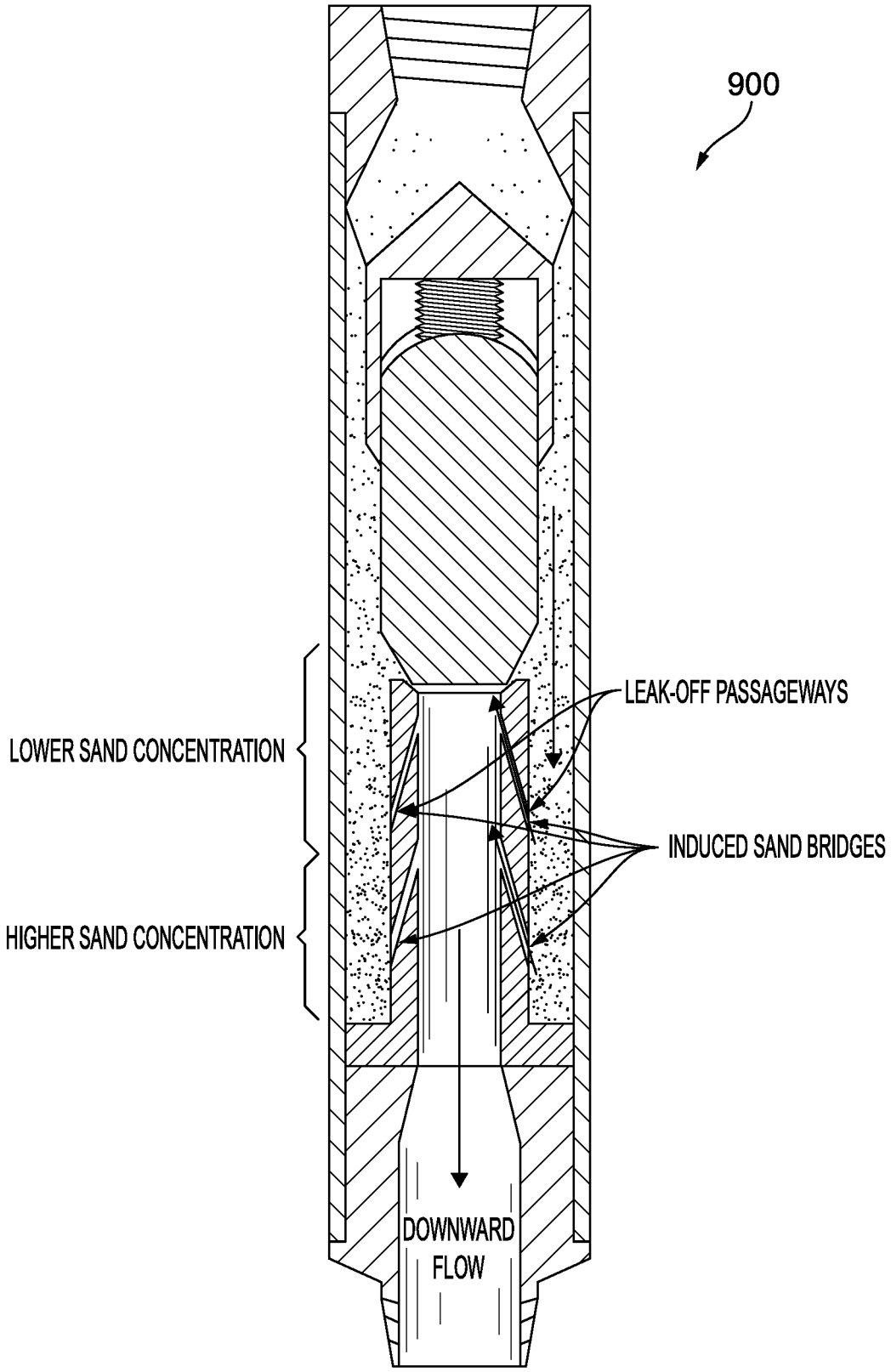
FIG. 15 is a cross-sectional view of the embodiment of FIG. 13, shown in a downflow condition wherein sand is accumulating and/or bridging in the downhole tool.

The sand bridge inducer 916 can be used in any suitable manner within any suitable well system and/or well tool (e.g., used as a valve seat 916 as shown in FIGS. 13-15). It is contemplated herein that the sand bridge inducer 916 need not be utilized as a valve component, can be utilized as a standalone device in any suitable flow path.

FIG. 13 shows the tool 900 in a normal upflow condition (e.g., when a pump is turned on). In this regard, flow travels up through the main opening 917 and through the angled passageways 919*a*, 919*b*, for example. With a flow rate greater than tool 900 designed flow range, sufficient drag force, and/or during periods when inducer 916 is plugged (e.g., from sand or debris) causing a sufficiently high pressure differential, the poppet 920 may be unseated from the sand bridge inducer 916 and allow flow past the poppet 920 (and/or for debris to be flushed therefrom).

Referring to FIG. 14, the tool 900 is shown subjected to downward flow (e.g., soon after turning a pump off). As shown the flow is still mostly liquid. The flow is allowed to pass through the angled passageways 919*a*, 919*b* to enter the main opening 917 to continue along the flow path downward.

Referring to FIG. 15, the tool 900 is shown subjected to a downward flow where sand has fallen back down and accumulated in the tool 900. With a configuration where the smaller passageway 919*a* is disposed above a larger passageway 919*b*, a "leak-off" effect occurs. In this situation, the "leak-off" induces a higher concentration of sand at the lower and larger second passageway 919*b*.

As described above, the angled passageways 919*a*, 919*b* can have small gaps (e.g., high aspect ratios) that are wide thereby allowing for an overall large flow area. The small gap size is sized to promote a sand bridging effect when sand concentrations rise. When sand bridges form in/at all the narrow gap passageways (e.g., passageways 919*a* and/or 919*b*), this effectively impedes sand fall-back.

As described above, embodiments include a valve that includes an upper poppet and a sand bridge inducer. In such embodiments, the poppet does not need to have internal flow paths. Embodiments use the poppet to ensure upward flow by opening when the sand bridge inducer 916 becomes plugged due to sand slug events or short periods of thick debris that has been produced through the ESP pump. When the poppet opens during normal upward flow, any solids or debris attempting to plug the sand bridge inducer at radially inward opening 923*a* and/or 923*b* can be flushed through the tool thereby allowing the tool to return to normal operation.

Embodiments as described above can include narrow yet wide passageways that are cut at aggressive angles into the sand bridge inducer 916. These passageways hydraulically can connect the lower part of the valve with the upper part of the valve. Embodiments can effectively create "plate-flow" (flow between two flat plates) which can promote sand bridging. Yet, because embodiments can also include a wide (horizontal) dimension the overall flow area is enlarged. The increased flow area can aid in reducing localized flow velocities and overall pressure drop across the tool. Reduced flow velocity can also promote sand bridging during downward flow (fall-back) while also reducing erosion during normal upward flow.

Also as described above, certain embodiments include upper passageways that have the narrowest gap while the lowest passageways have the largest gap. When a fall-back event occurs, sand particle and fluid will first reach the small gap passageways. In such embodiments where these passageways are smaller, sand particles are less encouraged to enter the passageway and therefore continue flowing downward toward the large gap passageways. Meanwhile, fluid particles easily flow through the small gap passageways (e.g. 919*a*) thereby causing a "leak-off" effect. Fluid effectively "leaks" from the slurry which can increase the slurry's sand concentration just below the small gap passageways, and prior to the large gap passageway (e.g. 919*b*).

Certain embodiments can have small gap lower passageways that are designed to easily form a sand bridge when sand concentrations are lower, and thus do not require leak-off support. Gap size selection of the angled passageways can be related to the targeted sand particle size. For example, the gap dimension can be designed from one to three times the diameter of the target particle size in certain embodiments. Since leak-off causes an increased sand concentration that promotes sand bridging in the lower yet larger gap passageways, such passageways may be designed anywhere from three to six times the diameter of the target particle size. As sand concentration ranges increase, the gap size may also be increased because an increasing sand concentration also promotes sand bridging.

As described above, utilizing plate-flow geometry with graduated gap sizes allows for an overall effective and efficient means of flow-back while quickly inducing a sand bridge if sand particles are present. If no sand was present, embodiments would cause little flow restriction resulting in a flow-back rate nearly equal to a system not having the tool installed. This can be because of the flow area achieved by cumulating all the angled passageways. The number of angled passageways (and overall tool length) can be minimized using graduated gap sizing.

After a sand bridge has been formed during a fall-back event, the tool then causes fall-back sand to remain in the production tubing above the tool instead of flowing back into/onto the ESP pump. When the ESP pump has been successfully restarted the fluid below the tool is pressurized. This pressure is instantly communicated through the plate-like passageways and to the sand column in and above the tool. Once this occurs, the buoyancy of the sand changes and the sand column begins to re-fluidize. Once the sand column has been re-fluidized sand particles will begin to flow upward toward the surface. After flow has been established the sand that was once bridged in the tool will flow out (and upward) from the tool. If clogging occurs in the sand inducer element passageways at openings 923*a*/923*b* the poppet will open due to the differential pressure established by the pressure just below the poppet seat and the pressure in the upper chamber just above the poppet. When the poppet opens, debris/sand in 917 will clear through the tool and fluidization of the sand column above the tool will be improved and therefore promoting sand production upward and away from the tool.

In accordance with any of the foregoing embodiments, in both the open and closed positions, the valve poppet can be at least partially within the upper chamber so that the upper chamber is always enclosed to prevent accumulation of fall-back sand above the valve poppet. In accordance with any of the foregoing embodiments, a biasing member can be seated in the upper chamber biasing the valve poppet toward the valve seat.

In accordance with any of the foregoing embodiments, the upper member can include an upper surface with at least one angled portion that is angled to resist accumulation of sand on the upper surface.

In accordance with any of the foregoing embodiments, the valve poppet can be narrower than the upper chamber to allow movement of the valve poppet without resistance from fall-back sand or debris.

In accordance with any of the foregoing embodiments, the valve poppet can include an axially oriented perimeter surface matched in shape with an axially oriented interior surface of the upper chamber.

In accordance with any of the foregoing embodiments, a wiper seal or similar functioning seal can engage between the valve poppet and the upper member, wherein the seal is configured to allow passage of fluid while inhibiting passage of sand or debris.

In accordance with any of the foregoing embodiments, a weep hole can be defined through the upper member from a space outside the upper chamber to a space inside the upper chamber, wherein the weep hole is configured to equalize pressure between the space outside the upper chamber with the space inside the upper chamber. A filter material can be included within the weep hole.

In accordance with any of the foregoing embodiments, the valve seat can be defined by an angular surface configured to encourage wedging of sand during closing of the valve poppet against the valve seat.

In accordance with any of the foregoing embodiments, a poppet channel can be defined through the valve poppet for limited fluid communication through the flow path with the valve poppet in the closed position. The poppet channel can have a flow area equal to one-half of that through the flow path or greater. The poppet channel can include a tributary with an opening on a peripheral surface of the poppet valve, wherein the tributary of the poppet channel is directed downward toward the valve seat for initiating a buoyancy change in sand seated between the valve seat and the valve poppet prior to the valve poppet moving from the closed position to the open position. The tributary of the poppet channel can be defined along a tributary axis angled downward, e.g., 45° from level.

In accordance with any of the foregoing embodiments, the housing can include a head including the upper member and upper opening, a base including the lower opening and the valve seat, and a housing body mounted to the head and base, spacing the head and base apart axially.

In accordance with any of the foregoing embodiments, back flow can be allowed through a poppet channel defined through the valve poppet.

In accordance with any of the foregoing embodiments, initiating movement of the valve poppet from the closed position to an open position can be done by directing flow through a tributary of a poppet channel defined through the valve poppet, wherein the flow through the tributary is directed at sand accumulated between the valve poppet and an adjacent valve seat.

In accordance with any of the foregoing embodiments, increasing flow through the ESP can move the valve poppet into an open position for flow through the flow path, and accumulated fall-back sand can be discharged from a tool including the valve poppet in an upward direction.

In accordance with any of the foregoing embodiments, a downhole tool for sand fall-back prevention can include a housing defining a flow path therethrough in an axial direction from an upper opening to a lower opening, and a poppet valve mounted within the housing, wherein the poppet valve includes an upper member defining an upper chamber mounted in the flow path so that flow through the flow path flows around the upper member, a sand bridge inducer valve seat mounted in the flow path with a main opening therethrough, wherein the sand bridge inducer valve seat includes one or more angled passageways defined through a wall of the sand bridge inducer valve seat such that the one or more angled passageways open from a radially inward opening and traverse axially downward through the wall of the sand bridge inducer valve seat toward a radially outward opening, and a valve poppet mounted for longitudinal movement within the flow path between a closed position in which the valve poppet seats against the sand bridge inducer valve seat to block flow through the flow path and an open position in which the valve poppet is spaced apart from the valve seat to permit flow through the flow path.

In accordance with any of the foregoing embodiments, the one or more angled passageways can include one or more linear or curved passageways defined between a respective radially inward opening and radially outward opening.

In accordance with any of the foregoing embodiments, the one or more angled passageways can include one or more plate flow passageways including a rectangular cross-section.

In accordance with any of the foregoing embodiments, a cross-sectional area of the one or more plate flow passageways include a 10:1 width to gap ratio, and wherein the plate flow passageways include a depth to gap ratio of 20:1.

In accordance with any of the foregoing embodiments, at least one of the one or more angled passageways can be sized to promote a sand bridging effect therein without allowing sand to travel into the main opening.

In accordance with any of the foregoing embodiments, the one or more angled passageways can include at least two passageways of different flow area.

In accordance with any of the foregoing embodiments, a first passageway of the at least two passageways can have a smaller flow area than a second passageway, wherein the first passageway is disposed axially upward of the second passageway.

In accordance with any of the foregoing embodiments, the smaller first passageway can be sized to allow leak-off from downflow and the larger second passageways can be designed to allow sand bridging therein.

In accordance with any of the foregoing embodiments, the at least one of the angled passageways can include an angle of 45 degrees.

In accordance with any of the foregoing embodiments, the sand bridge inducer valve seat can include a top hat shape with a flow opening in a top thereof and a mounting flange axially opposed to the top, wherein an interface between the poppet and the sand bridge inducer valve seat can be at a top of the top hat shape.

In accordance with any of the foregoing embodiments, a sand bridge inducer for a downhole tool includes a wall defining a main opening therethrough and one or more angled passageways defined through the wall such that the one or more angled passageways open from a radially inward opening and traverse axially downward through the wall toward a radially outward opening.

In accordance with any of the foregoing embodiments, the one or more angled passageways can include one or more linear or curved passageways defined between a respective radially inward opening and radially outward opening.

In accordance with any of the foregoing embodiments, the one or more angled passageways can include one or more plate flow passageways including a rectangular cross-section.

In accordance with any of the foregoing embodiments, a cross-sectional area of the one or more plate flow passageways include a 10:1 width to gap ratio, and wherein the plate flow passageways include a depth to gap ratio of 20:1.

In accordance with any of the foregoing embodiments, at least one of the one or more angled passageways can be sized to promote a sand bridging effect therein without allowing sand to travel into the main opening.

In accordance with any of the foregoing embodiments, the one or more angled passageways can include at least two passageways of different flow area.

In accordance with any of the foregoing embodiments, a first passageway of the at least two passageways can have a smaller flow area than a second passageway, wherein the first passageway is disposed axially upward of the second passageway.

In accordance with any of the foregoing embodiments, the smaller first passageway can be sized to allow leak-off from downflow and the larger second passageways can be designed to allow sand bridging therein.

In accordance with any of the foregoing embodiments, the at least one of the angled passageways can include an angle of 45 degrees.

In accordance with any of the foregoing embodiments, the sand bridge inducer valve seat can include a top hat shape with a flow opening in a top thereof and a mounting flange axially opposed to the top, wherein an interface between the poppet and the sand bridge inducer valve seat can be at a top of the top hat shape.

The methods and systems of the present disclosure, as described above and shown in the drawings, provide for reduction or prevention of fall-back sand reaching an ESP with superior properties including accommodation for desirable back flow, extended useable life, and improved reliability relative to traditional systems and methods. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A downhole tool for sand fall-back prevention comprising:

a housing defining a flow path therethrough in an axial direction from an upper opening to a lower opening; and a poppet valve mounted within the housing, wherein the poppet valve includes:

an upper member defining an upper chamber mounted in the flow path so that flow through the flow path flows around the upper member;

a sand bridge inducer valve seat mounted in the flow path and having a seat portion thereon with a main opening therethrough, wherein the sand bridge inducer valve seat includes one or more angled passageways defined through a wall of the sand bridge inducer valve seat downhole of the seat portion such that the one or more angled passageways open from a radially inward opening and traverse axially downward through the wall of the sand bridge inducer valve seat toward a radially outward opening; and a valve poppet mounted for longitudinal movement within the flow path between a closed position in which the valve poppet seats against the seat portion of the sand bridge inducer valve seat to block flow through the flow path and an open position in which the valve poppet is spaced apart from the seat portion of the valve seat to permit flow through the flow path, wherein fluid flows through the one or more angled passageways into an interior of the sand bridge inducer valve seat when the valve poppet is in the closed position.

2. The downhole tool of claim 1, wherein the one or more angled passageways include one or more linear passageways defined between a respective radially inward opening and radially outward opening.

3. The downhole tool of claim 1, wherein the one or more angled passageways include one or more plate flow passageways including a rectangular cross-section.

4. The downhole tool of claim 3, wherein a cross-sectional area of the one or more plate flow passageways include a 10:1 width to gap ratio or greater, and wherein the plate flow passageways include a depth to gap ratio of 20:1 or greater.

5. The downhole tool of claim 1, wherein at least one of the one or more angled passageways are sized to promote a sand bridging effect therein without allowing sand to travel into the main opening.

6. The downhole tool of claim 1, wherein the one or more angled passageways include at least two passageways of different flow area.

7. The downhole tool of claim 6, wherein a first passageway of the at least two passageways has a smaller flow area than a second passageway, wherein the first passageway is disposed axially upward of the second passageway.

8. The downhole tool of claim 7, wherein the smaller first passageway is sized to allow leak-off from downflow and the larger second passageways is designed to allow sand bridging therein.

9. The downhole tool of claim 1, wherein the at least one of the angled passageways include an angle of 45 degrees or greater.

10. The downhole tool of claim 1, wherein the sand bridge inducer valve seat includes a top hat shape with a flow opening in a top thereof and a rim axially opposed to the top, wherein an interface between the poppet and the sand bridge inducer valve seat is at the top of the top hat shape.

11. A sand bridge inducer for a downhole tool, comprising:

an interface portion;

a wall extending downward from the interface portion and defining a main opening therethrough; and one or more angled passageways defined through the wall such that the one or more angled passageways open from a radially inward opening and traverse axially downward through the wall toward a radially outward opening;

wherein fluid flows though the one or more angled passageways into an interior of the sand bridge inducer and out an end of the downhole tool downward from the interface portion when the interface portion is closed.

12. The sand bridge inducer of claim 11, wherein the one or more angled passageways include one or more linear or curved passageways defined between a respective radially inward opening and radially outward opening.

13. The sand bridge inducer of claim 11, wherein the one or more angled passageways include one or more plate flow passageways including a rectangular cross-section.

14. The sand bridge inducer of claim 13, wherein a cross-sectional area of the one or more plate flow passageways include a 10:1 width to gap ratio or greater, and wherein the plate flow passageways include a depth to gap ratio of 20:1 or greater.

15. The sand bridge inducer of claim 11, wherein at least one of the one or more angled passageways are sized to promote a sand bridging effect therein without allowing sand to travel into the main opening.

16. The sand bridge inducer of claim 11, wherein the one or more angled passageways include at least two passageways of different flow area.

17. The sand bridge inducer of claim 16, wherein a first passageway of the at least two passageways has a smaller flow area than a second passageway, wherein the first passageway is disposed axially upward of the second passageway.

18. The sand bridge inducer of claim 17, wherein the smaller first passageway is sized to allow leak-off from downflow and the larger second passageways is designed to allow sand bridging therein.

19. The sand bridge inducer of claim 11, wherein the at least one of the angled passageways include an angle of 45 degrees or greater.

20. The sand bridge inducer of claim 11, wherein the wall includes a top hat shape, wherein a top of the top hat shape is configured to be an interface between a poppet and the sand bridge inducer such that the sand bridge inducer acts as a valve seat for the poppet.

* * * * *